US012207749B1

(12) United States Patent
Saad

(10) Patent No.: US 12,207,749 B1
(45) Date of Patent: Jan. 28, 2025

(54) TECHNIQUES FOR LYING PRONE COMFORTABLY

(71) Applicant: Kristine Saad, Austin, TX (US)

(72) Inventor: Kristine Saad, Austin, TX (US)

( * ) Notice: Subject to any disclaimer, the term of this patent is extended or adjusted under 35 U.S.C. 154(b) by 0 days.

(21) Appl. No.: 18/624,061

(22) Filed: Apr. 1, 2024

(51) Int. Cl.
*A47G 9/10* (2006.01)

(52) U.S. Cl.
CPC .... *A47G 9/1054* (2013.01); *A47G 2009/1018* (2013.01)

(58) Field of Classification Search
CPC .... A47C 20/026; A47C 7/383; A61G 13/121; A47G 9/1054
See application file for complete search history.

(56) References Cited

U.S. PATENT DOCUMENTS 2,336,707 A * 12/1943 Thompson ..... A47C 7/383 5/636
3,312,987 A 4/1967 Emery
3,926,181 A * 12/1975 Eischen, Sr. ..... A47G 9/10 602/18
6,151,734 A * 11/2000 Lawrie ..... A47C 20/026 5/643
6,691,354 B1 * 2/2004 Sheppard ..... A47C 27/081 5/733
D555,251 S * 11/2007 Riach ..... D24/184
8,468,628 B1 6/2013 Cheng
8,769,745 B1 * 7/2014 Lin ..... A61G 7/072 5/643
8,850,641 B2 10/2014 Marbury, III
9,131,791 B2 9/2015 Schwingendorf et al.
9,980,580 B2 5/2018 O'Donnell
(Continued)

FOREIGN PATENT DOCUMENTS

CN 209154372 U * 7/2019
DE 2430213 A1 1/1976
(Continued)

OTHER PUBLICATIONS

Amazon.com, https://www.amazon.com/NRG-Memory-Massage-Table-Cradle/dp/B075F6BGB8?, accessed on Apr. 24, 2024, 8 pages.

(Continued)

*Primary Examiner* — Eric J Kurilla
(74) *Attorney, Agent, or Firm* — Beckman Law P.C.; Christopher Beckman

(57) ABSTRACT

New systems, devices and methods for aiding comfort during rest and relaxation while lying in a prone position are provided, including a new type of pillow aiding human users in lying in the prone position (a "prone lying enhancement pillow"). A generally U-shaped prone lying enhancement pillow is provided, including a perimetric fitment to a human user's face, in which aspects of the pillow hugs the outer contours of the human face. In some embodiments, such an aspect includes a surface of the pillow facing the user's forehead. Such a surface includes a concave area of the pillow that touches and interfaces differently with specific contours of the human face, and includes an angled and contoured bevel. Such a surface may touch and interface with a majority of the user's forehead and/or parts of the sides of the face, providing less pressure on other areas of the face.

20 Claims, 6 Drawing Sheets

(56) References Cited

U.S. PATENT DOCUMENTS

| | | | | |
|---|---|---|---|---|
| 10,085,575 | B2 | 10/2018 | Vogel | |
| 10,722,054 | B2 | 7/2020 | Staton | |
| 11,278,136 | B2 | 3/2022 | Murphy | |
| 11,311,123 | B2 | 4/2022 | Morden | |
| 2005/0109346 | A1* | 5/2005 | Cohen | A61G 13/12 128/845 |
| 2005/0177946 | A1* | 8/2005 | Riley | A61G 13/12 5/638 |
| 2006/0053557 | A1* | 3/2006 | Damron | A61G 13/121 5/636 |
| 2007/0056108 | A1* | 3/2007 | Nikolopoulos | A47G 9/1054 5/636 |
| 2015/0230635 | A1 | 8/2015 | Abrams | |
| 2015/0245968 | A1* | 9/2015 | Mitchell | A61H 39/04 5/638 |
| 2016/0120725 | A1* | 5/2016 | Slattery | A61G 13/121 5/622 |
| 2017/0280902 | A1* | 10/2017 | Chan | A47C 7/383 |
| 2018/0042409 | A1 | 2/2018 | Johnson | |
| 2022/0248883 | A1 | 8/2022 | Williams | |
| 2022/0296449 | A1* | 9/2022 | Martin | B01D 39/1623 |

FOREIGN PATENT DOCUMENTS

| | | | |
|---|---|---|---|
| DE | 202013008635 | U1 | 10/2013 |
| GB | 2323277 | B | 12/1999 |
| KR | 2020019066 | A | 2/2020 |

OTHER PUBLICATIONS

Earththerapeutics.com, https://www.earththerapeutics.com/products/anti-stress-face-pillow, accessed Apr. 24, 2024, 3 pages.

Snapklik.com, https://snapklik. com/en-ca/product/therapists-choice-universal-headrest-face-cushion-face-pillow-for-massage-table-and-massage-chair-agate-blue-13x13x4-inch/09LE4PV7CYXH5, accessed on Apr. 24, 2024, 8 pages.

* cited by examiner

TECHNIQUES FOR LYING PRONE COMFORTABLY

INTELLECTUAL PROPERTY NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Unless otherwise stated, all trademarks and trade dress disclosed in this patent document and other distinctive names, emblems, and designs associated with product or service descriptions, are subject to trademark rights. The trademark and trade dress owner also reserves all trademark rights whatsoever.

FIELD OF THE INVENTION

The present disclosures relate to new systems, devices and methods aiding comfort during rest and relaxation and, more specifically, to new forms of cushions aiding human users in lying in the prone position.

BACKGROUND

The use of implements, such as cushions, mattresses, pillows and furniture, for lying down comfortably probably predates recorded history. Simple beds date at least to 3600 B.C.E., in sub-Saharan Africa. Beds dating from 3200 to 2200 B.C.E. were also found in Northern Scotland, constructed from raised boxes made of stone. By the time of Medieval Europe, beds were being constructed from piles of leaves, moss, feathers, and other soft materials, covered by animal hides.

Pillows have been in use, at least, since ancient Mesopotamia, around 7,000 B.C.E. In addition to supporting and providing comfort for the user's head, pillows also serve as a barrier to protect users from insects. Furthermore, being a luxury item, the number of pillows owned by a user has operated as a status symbol, displaying the wealth of the user.

Pillows are available in a variety of shapes, but, most typically, modern pillows are provided in a rectangular format, including a soft fill (e.g., goose down or a synthetic fill) surrounded by one or more layers of fabric. Predominantly for sanitary reasons, users also typically cover the pillow with an additional layer of material, in the form of a bag slightly larger than the pillow, known as a pillowcase. A pillowcase may be washed periodically, to reduce the accumulation dust, oils and insect or other infections of the main body of the pillow. Some pillowcases are decorative in nature, including an ornamental design, either in the form of a printed pattern or extensions of the pillowcase, such as tassels and fringe.

One type of pillow having an unconventional U-shaped format, is known as the "neck pillow" or orthopedic pillow, which is frequently used in travel settings, especially on airplanes. Similar to neck braces, the U-shape of the neck pillow allows it to be drawn around the user's neck, supporting it and the user's head, and allows the user rest her or his neck muscles, and even sleep in an upright position, in an airplane seat.

Including the somewhat unusual upright position discussed above, human users may adopt a wide variety of positions while sleeping. Most commonly, users sleep lying flat on their backs (i.e., the "supine position") with their arms flat beside them. Some sleepers prefer to sleep rolled onto their sides (i.e., "side sleepers"), and may prefer resting predominantly on their right or left sides. Less typically, users will sleep on their stomach (the "prone position). The prone position may be comfortable for users for a short period of time, but requires the user to turn their neck to the side to breathe, which can prove to be uncomfortable over prolonged time periods. Pillows generally require a user to turn the neck even more than a mattress alone in this position, and sometimes, for some users, the prone position may be assumed more comfortably without a pillow. A number of pillows and cushions have been attempted in an effort to improve sleep and comfort, including while in the prone position. But sleep and rest in the prone position remains uncomfortable and unpopular. Nonetheless, some users include the prone position during sleeping, even if not for long due to this discomfort, to add variety and relieve and prevent other discomfort from over-relying on a more limited set of sleeping positions (e.g., bed sores). Whatever their preference for sleeping position, most sleepers will usually oscillate between multiple positions (e.g., a side sleeper alternating between resting on their right and left sides, and occasionally sleeping in the supine position).

There remains a strong and long-felt need for better rest and relaxation techniques improving the comfort of human users and, in particular, while resting and sleeping in the prone position.

It should be understood that the disclosures in this application related to the background of the invention, in, but not limited to, this section titled "Background," do not necessarily set forth prior art or other known aspects exclusively, and may instead include art that was invented concurrently or after the present invention and conception, and details of the inventor's own discoveries and work and work results.

SUMMARY OF THE INVENTION

New systems, devices and methods for aiding comfort during rest and relaxation while lying in the prone position are provided, including a new type of pillow aiding human users in lying in the prone position (a "prone lying enhancement pillow"). In some embodiments, a generally U-shaped prone lying enhancement pillow is provided, including a perimetric fitment to a human user's face, meaning that an aspect of the pillow interfaces with an outer area of the human user's face, while the human user lays in the prone position. In some such embodiments, such a perimetric fitment is approximately and/or partially perimetric, or at least surrounding a central area of the human user's face. In some such embodiments, an aspect(s) of the pillow touches and interfaces with the forehead and outer sides of the human face. In some such embodiments, such an aspect(s) includes a compliant yet supportive cushion that hugs the outer contours of the human face. In some embodiments, such an aspect(s) includes a surface of the pillow facing the user's forehead, which, in some such embodiments, covers a majority of the user's forehead. In some embodiments, such a surface includes a concave area of the pillow that touches and interfaces differently with specific contours of the human face. In some such embodiments, such a concavity includes an angled and contoured bevel, with a complementary fitment to a human user's face. For example, in some embodiments, such a surface touches and interfaces with a majority of the user's forehead, thereby providing support and selective pressure to the user's forehead, and less pressure on other areas of the user's face, even if touching and interfacing with such other areas.

In some embodiments, a pillow in accordance with aspects of this application is about 5 inches wide by 6 inches in length. However, in some embodiments, the length of such a pillow (measured along the length of a human face placed into it, as pictured below), may be shorter than its width. However, in some embodiments, which are preferred, the width and length of such a pillow may be the same, or approximately the same (e.g., 6 inches by 6 inches, or 5 inches by 5 inches).

Canons of Construction

Where any term is set forth in a sentence, clause or statement ("statement") in this application, each possible meaning, significance and/or sense of any term used in this application should be read as if separately, conjunctively and/or alternatively set forth in additional statement(s), after the sentence, clause or statement, as necessary to exhaust the possible meanings of each such term and each such statement.

It should also be understood that, for convenience and readability, this application may set forth particular pronouns and other linguistic qualifiers of various specific gender and number, but, where this occurs, all other logically possible gender and number alternatives should also be read in as both conjunctive and alternative statements, as if equally, separately set forth therein.

The embodiments set forth in detail in this application are to ease the reader's understanding of inventions set forth herein and, as such, are only examples of the virtually innumerable number of alternative embodiments falling within the scope of the application. No specific embodiment set forth in this application should be read as limiting the scope of any claimed inventions.

These and other aspects of the invention will be made clearer below, in other parts of this application. This Summary, the Abstract, and other parts of the application, are for ease of understanding only, and no part of this application should be read to limit the scope of the invention, whether or not it references matter also set forth in any other part.

BRIEF DESCRIPTION OF THE DRAWINGS

The features and advantages of example embodiments of the invention presented herein will become more apparent from the detailed description set forth below when taken in conjunction with the following drawings.

DETAILED DESCRIPTION OF THE INVENTION

Figure 1:
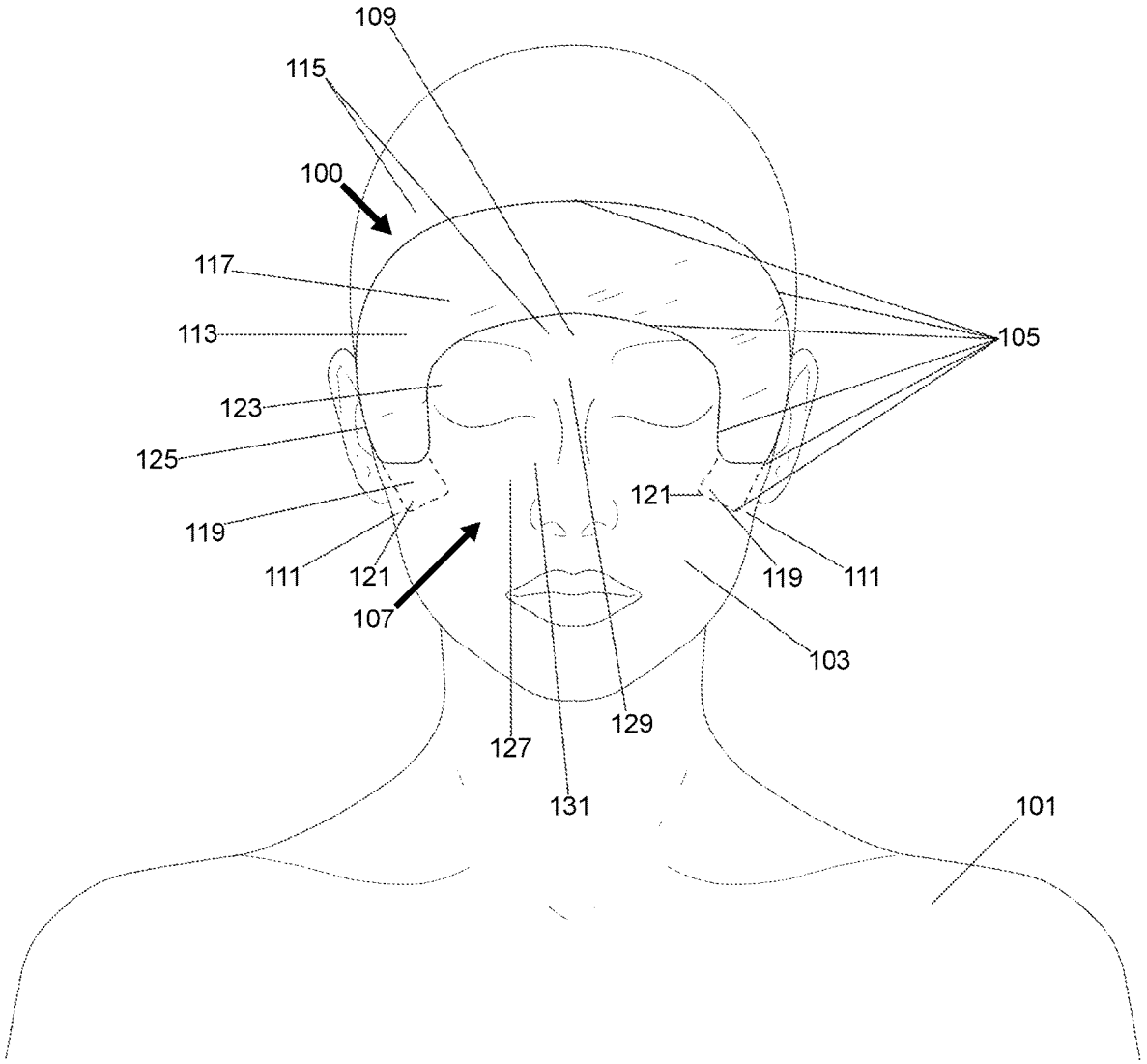
FIG. 1 is a bottom view drawing of an example prone lying enhancement pillow, shown aiding a human user in lying in the prone position, in accordance with some embodiments of the present application.

The features and advantages of example embodiments of the invention presented herein are directed to new systems, devices and methods for aiding comfort during rest and relaxation while lying in the prone position are provided, including a new type of pillow aiding human users in lying in the prone position, which are now described herein. These and other aspects will become more apparent from the detailed description set forth below when taken in conjunction with the drawings. This description is not intended to limit the application to the embodiments presented herein, which are only examples of the virtually unlimited possible embodiments falling within the scope of the present application. In fact, after reading the following description, it will be apparent to one skilled in the relevant art(s) how to implement the following example embodiments in alternative embodiments, including any possible order, number or other arrangement of components and subcomponents (the following orders, components, subcomponents and/or relationships being non-limiting).

Embodiments of systems, devices and methods for aiding comfort during rest and relaxation while lying in the prone position in accordance with some aspects set forth in this Specification are depicted in FIGS. 1-9. The following is a list of defined components and/or aspects and reference numbers therefor, as used throughout the figures:

| Reference No. | Component |
|---|---|
| 100 | prone lying enhancement pillow |
| 101 | human user |
| 103 | face (of human user 101) |
| 105 | outer area (of human user 101's face 103) |
| 107 | central area (of human user 101's face 103) |
| 109 | forehead (of human user 101) |
| 111 | sides (of human user 101's face 103) |
| 113 | compliant yet supportive cushion |
| 115 | uncovered areas (of human user 101's forehead 109) |
| 117 | floor-facing surface (of prone lying enhancement pillow 100) |
| 119 | ancillary lower extensions (of prone lying enhancement pillow 100) |
| 121 | lower tips (of prone lying enhancement pillow 100) |
| 123 | eye area (of human user 101's face 103) |
| 125 | Temple (of human user 101's face 103) |
| 127 | sinus area (of human user 101's face 103) |
| 129 | central open area (of prone lying enhancement pillow 100) |
| 131 | central channel (of prone lying enhancement pillow 100) |
| 200 | prone lying enhancement pillow (alternative embodiment) |
| 201 | visible portion (prone lying enhancement pillow 200's U-shape) |
| 203 | floor |

-continued

| Reference No. | Component |
|---|---|
| 205 | head (of human user 101) |
| 207 | prone position |
| 209 | perimetric fitment (of prone lying enhancement pillow 200 to human user's face 103) |
| 211 | force vector illustrating arrow (of weight and other downward pressure from human user's face 103) |
| 213 | face-and forehead-facing surface (of prone lying enhancement pillow 200) |
| 215 | compressed configuration (of prone lying enhancement pillow 200) |
| 217 | normal directional force arrow (from floor 203) |
| 219 | neck (of human user 101) |
| 300 | prone lying enhancement pillow (alternative embodiment) |
| 301 | interfacing surface |
| 303 | multiple levels (of topological features 305) |
| 305 | topological features 305 (of interfacing surface 301) |
| 307 | concave area(s) (of interfacing surface 301) |
| 309 | angled and contoured bevel (of concave area 307) |
| 400 | prone lying enhancement pillow (alternative embodiment) |
| 401 | interfacing surface |
| 403 | concave area (of interfacing surface 401) |
| 405 | angled and contoured bevel (of concave area 403) |
| 407 | locally raised areas |
| 409 | eye and temple pressure relief areas |
| 411 | elongated sides (of prone lying enhancement pillow 400) |
| 500 | prone lying enhancement pillow (alternative embodiment) |
| 501 | central open channel (of prone lying enhancement pillow 500) |
| 600 | prone lying enhancement pillow (alternative embodiment) |
| 700 | prone lying enhancement pillow (alternative embodiment) |
| 800 | prone lying enhancement pillow (alternative embodiment) |
| 900 | prone lying enhancement pillow (alternative embodiment) |

FIG. 1 is a bottom view drawing of an example prone lying enhancement pillow 100 shown in use aiding a human user 101 in lying in the prone position, in accordance with some embodiments of the present application. As can be seen in the figure, in some embodiments, prone lying enhancement pillow 100 is, at least generally, U-shaped. Unlike most other U-shaped pillows, however, the shape of prone lying enhancement pillow 100 is configured to aid in lying in a prone position by having a perimetric fitment to a human user's face, such as example human user 101's face 103. As used in the present application, a "perimetric fitment to a human user's face" means that an aspect of the pillow interfaces with an outer area of the human user's face, such as example outer area 105 of human user 101's face, while the human user lays in the prone position. In some such embodiments, such a perimetric fitment is approximately and/or partially perimetric, or at least surrounding a central area, such as example central area 107, of the human user's face.

In some such embodiments, an aspect(s) of the pillow touches and interfaces with the forehead, such as example human user 101's forehead 109, and outer sides, such as example sides 111, of the human face. And, in some embodiments, such an aspect(s) includes a compliant yet supportive cushion 113 that hugs outer contours of the human face. In some embodiments, such an aspect(s) includes a surface of the pillow (not visible in the present figure) facing the user's forehead, which, in some such embodiments, covers a majority of the user's forehead (such as example human user 101's forehead 109) when in use, as pictured. In some embodiments, the contours are especially closely-fitted on or about the temples of the human face, and provide beneficial acupressure at those pressure points, reducing fatigue and sinus pressure. However, in some embodiments, supportive cushion 113 does not cover or contact all of the human user's forehead. In some such embodiments, at least some uncovered areas 115 remain uncovered, and, in some such embodiments, the human user may shift cushion 113, e.g., up or down vertically on her or his face, to more comfortably fit prone lying enhancement pillow 100 to the human user's face. In some such embodiments, the surface of the pillow facing the user's forehead may include different levels and/or amounts of cushioning and support. And, in some such embodiments, by so shifting cushion 113 and interfacing such different levels with different features of her or his forehead and/or face, the human user may also alter the amount by which her or his face and head, such as example human user 101's face 103, is raised from a ground, floor or other surface (not pictured in the present figure) on which a floor-facing surface 117 is laid.

In some embodiments, a pillow in accordance with aspects of this application is about 5 inches wide by 6 inches in length. However, in some embodiments, the length of such a pillow (measured along the length of a human face placed into it, as pictured below), may be shorter than its width. However, in some embodiments, which are preferred, the width and length of such a pillow may be the same, or approximately the same (e.g., 6 inches by 6 inches, or 5 inches by 5 inches).

In some embodiments, ancillary lower extensions 119 are included in prone lying enhancement pillow 100. In some such embodiments, ancillary lower extensions 119 are located at and/or form a part of lower tips 121 of prone lying enhancement pillow 100. And, in some embodiments, ancillary lower extensions 119 include concavities on surfaces thereof facing the user's face (not pictured in the present figure). In some such embodiments, such concavities relieve pressure on or about the user's eye areas, temples and/or sinus areas, such as example eye area 123, example temple 125, and example sinus area 127, as pictured.

In any event, owing at least in part to the above-discussed perimetric fitment to a human user's face, in some embodiments, example prone lying enhancement pillow 100 includes a central open area 129 which, when the pillow is in use, is located at or about the human user's nose, mouth and/or eyes, and/or a central area, such as example central area 107, of the human user's face in some embodiments. In some embodiments, central open area 129 may be, or include, a cove, at or about the location of a user's nose and/or mouth when fitted properly to a user's face, as pictured. In some embodiments, example prone lying enhancement pillow 100 also includes a central channel 131, through which airflow is maintained to and from central open area 129, even when example prone lying enhancement pillow 100 is in use, aiding a human user in lying in the prone position, as will be discussed in greater detail below. In some such embodiments, the user's nose and/or mouth remains suspended above, and clear of, a surface on which prone lying enhancement pillow 100 is laid, within such a central open area, when so properly fitted, as pictured. And, In some embodiments, a more complex network of breathability passageways may be included, in addition to central open area 129.

In some embodiments, an air filtering material (e.g., a mesh) may be included, in a material at or about central open area 129, covering the user's face, or nose and/or mouth, to filter particles, chemicals or other things from entering the user's airway (not pictured).

It should be noted that the number, location(s) and arrangement(s) of any of the components discussed above, and elsewhere herein, may vary widely in different embodiments of the invention, the embodiments specifically set forth and pictured in this application being only exemplary of the virtually unlimited numbers, locations and arrangements falling within the scope of the inventions set forth herein, as will be readily apparent to those of skill in the art.

Figure 2:
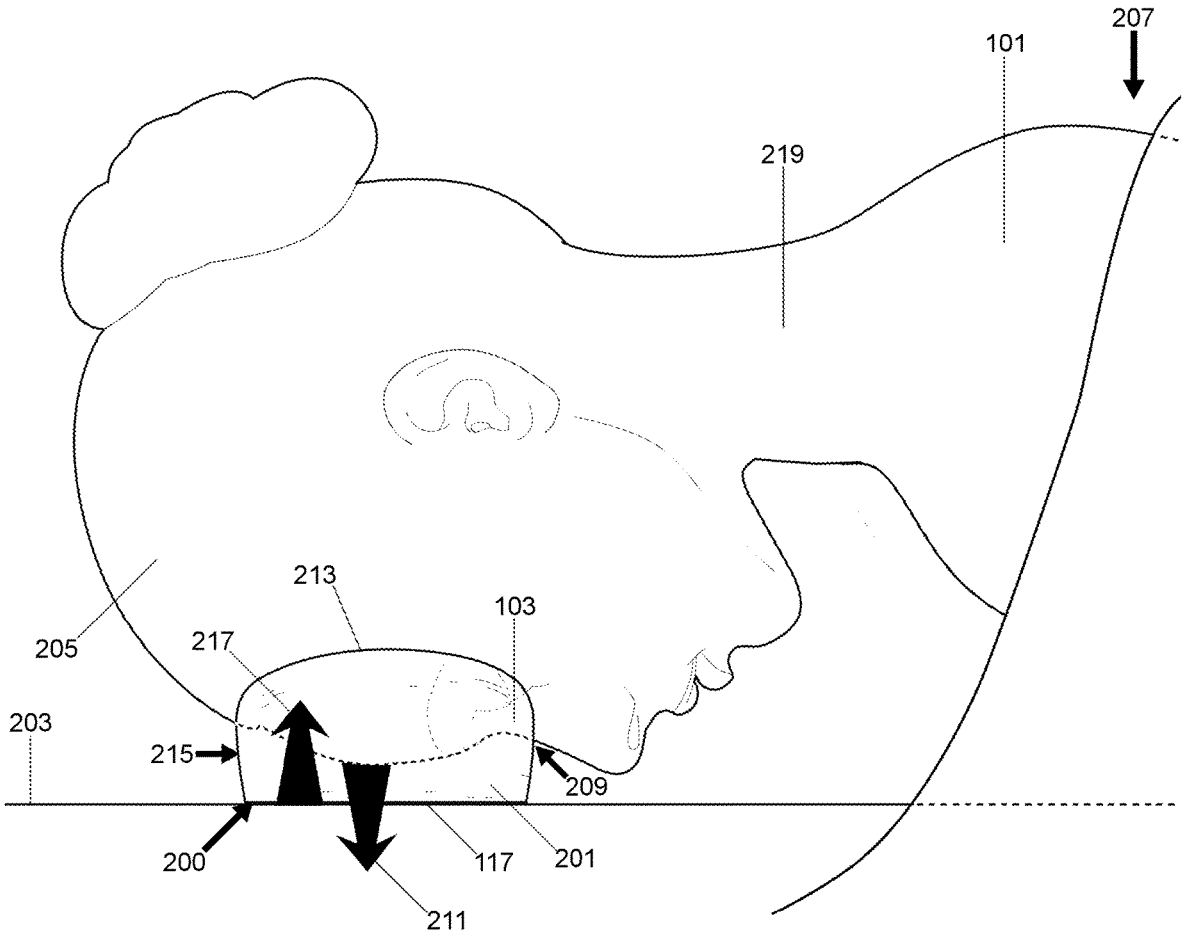
FIG. 2 is a side view drawing of an example prone lying enhancement pillow 200, shown in use by the same example human user, discussed above, in reference to FIG. 1, in accordance with some embodiments of the present application.

FIG. 2 is a side view drawing of an example prone lying enhancement pillow 200, shown in use by the same example human user 101, discussed above, in reference to FIG. 1, in accordance with some embodiments of the present application. In some embodiments, example prone lying enhancement pillow 200 may be the same as or at least similar in nature to the example prone lying enhancement pillow 100, also discussed above, in reference to FIG. 1. And, as with example prone lying enhancement pillow 100, in some embodiments, prone lying enhancement pillow 200 is at least generally U-shaped (although that at least generally U-shaped aspect may not be fully seen, only a limited visible portion 201 of the U-shape being now visible in the present perspective of the figure). As shown in the present figure, user 101 has placed prone lying enhancement pillow 200 against an example floor 203, and placed human user 101's head 205 face-down into it, in accordance with some embodiments. More specifically, as pictured, user 101 has placed floor-facing surface 117 against floor 203, laid down in a prone position 207, and inserted her face 103 into a central, open area of the pillow (not visible in the present figure, but the same as or similar in nature to central, open area 129, discussed above). In so doing, as discussed above, in some embodiments, the prone lying enhancement pillow (in this case, prone lying enhancement pillow 200) has a perimetric fitment 209 to a human user's face 103. In some embodiments, in so using prone lying enhancement pillow 200, the pillow reacts to weight from human user 101's head 205 and other downward pressure from human user's face 103, which are shown by force vector illustrating arrow 211, against the face- and forehead-facing surface 213 of the pillow facing the user's forehead 109, in some embodiments, by entering a compressed configuration 215. In such a compressed configuration 215, the prone lying enhancement pillow 200 generally shortens in elevation (in the perpendicular direction, illustrated by example normal directional force arrow 217, off of the floor 203, under that weight and pressure). It should be noted that, in some embodiments, the normal directional forces indicated by normal directional force arrow 217 are equal to, and exactly oppose in scale and direction, the weight from human user 101's head 205 and other downward pressure from human user's face 103, as discussed above. However, owing to firm, yet comfortable and supportive cushioning component(s) of prone lying enhancement pillow 200, as discussed further below, prone lying enhancement pillow 200 resists further compression, maintaining, or at least substantially maintaining, the compressed configuration 215 pictured.

In the compressed configuration 215, as pictured, prone lying enhancement pillow 200 supports human user 101's head 205 in a position aiding in producing a neutral position of human user 101's neck 219 and spine (not pictured, but within human user's neck 219), meaning that human user 101's neck is not, or not substantially, in a state of flexion, extension, lateral bending or rotation. In some embodiments, such a neutral position of human user 101's neck 219 and spine may be in a slight state of flexion, extension, lateral bending and/or rotation, but not by more than ten (10) degrees of flexion, extension, lateral bending and/or rotation. In some embodiments, such a neutral position of human user 101's neck 219 and spine is not in a state of flexion or extension by more than ten (10) degrees. In some embodiments, such a neutral position of human user 101's neck 219 and spine is not in a state of flexion or extension by more than about ten (10) degrees.

As will be apparent to those of skill in the art, prone lying enhancement pillow 200 and/or the firm, yet comfortable and supportive cushioning component(s) present within prone lying enhancement pillow 200, may include a wide variety of suitable material(s). For example, in some embodiments, such material(s) include a memory foam and/or a high density, small cell foam, which reacts to weight from human user 101's head 211 and other downward pressure against the forehead-facing surface 213, as discussed above, by compressing and conforming to the contours of human user 101's face 103, including forehead 109.

However, in some embodiments, prone lying enhancement pillow 200 is subject to compression under that weight from human user 101's head 211 and other downward pressure against the forehead-facing surface 213, as discussed above, to a limited degree. In other words, the compression of prone lying enhancement pillow 200, under the weight from human user 101's head 211 and other downward pressure against the forehead-facing surface 213, as discussed above, occurs in a limited range (e.g., with a maximum degree of compression at, or at about, the compressed configuration 215 pictured).

In some embodiments, prone lying enhancement pillow 200 and/or the firm, yet comfortable and supportive cushioning component(s) present within prone lying enhancement pillow 200, includes more than one material. In some embodiments, the firm, yet comfortable and supportive cushioning component(s) include an internal cushioning matrix.

Some embodiments of the pillow include cushioning including a suitably resilient, yet soft material(s), with limited compliance, to allow for the above-described support and compressed configuration 215). In some embodiments, such cushioning includes high-density foam (such as a memory foam). In some embodiments, such a material(s) is, or includes a polyester foam (e.g., a polyester memory foam) with about a 100% recovery rate. In some embodiments, such a material(s) is or includes a small-cell, polyurethane foam of a high density is used. In some embodiments, such a material(s) is or includes a medium firm density and/or a sufficient compression rate to support a user's face while maintaining the central open area 129 and central channel 131, discussed above. For example, in some embodiments, the cushioning matrix of the pillow has an Indentation Force Deflection ("compression rating" or "IFD") of somewhere in the range of 12-75 pounds (to compress the cushioning matrix 25%). However, preferably, in some embodiments, the cushioning matrix of the pillow has a compression rating in the range of 35-50 pounds, where a 12" Long×12" Wide×1" thick foam pillow cushioning piece is used as the cushioning matrix, or, in some alternative embodiments, where a 5" Long×5" Wide×2" thick foam pillow cushioning piece is used as the cushioning matrix. However, in some embodiments the cushioning matrix of the pillow has a compression rating of 44 pounds, which is preferred to some other values within that range. Even more preferably, in some embodiments, the cushioning matrix of the pillow has a compression rating of 45 pounds. In some embodiments, the density of the cushioning is at least about 2.8 pounds per cubic foot, where polyurethane foam is used as the cushioning matrix, or considerably higher, in some such embodiments.

In some embodiments, the pillow is personalized in shape, to follow the contours of an individual's face.

In some embodiments, the pillow includes additional material(s), such as a material selected from any or all of the following: Bamboo, a nylon (e.g., recycled nylon), neoprene, a moisture-wicking material, linen, silk, chambray, cotton, a micro modal material and viscose.

It should be understood that, although certain suitable material(s) for certain example prone lying enhancement pillow embodiments have been set forth above, for illustrative purposes, the inventions set forth in the present application are of course not limited by those specific examples, and should not be interpreted as limiting the scope of the inventions set forth herein. A wide variety of alternative, suitable materials, and combinations thereof, being virtually unlimited and impossible or impractical to innumerate herein, are also within the scope of the invention, as will be readily apparent to those of skill in the art.

Figure 3:
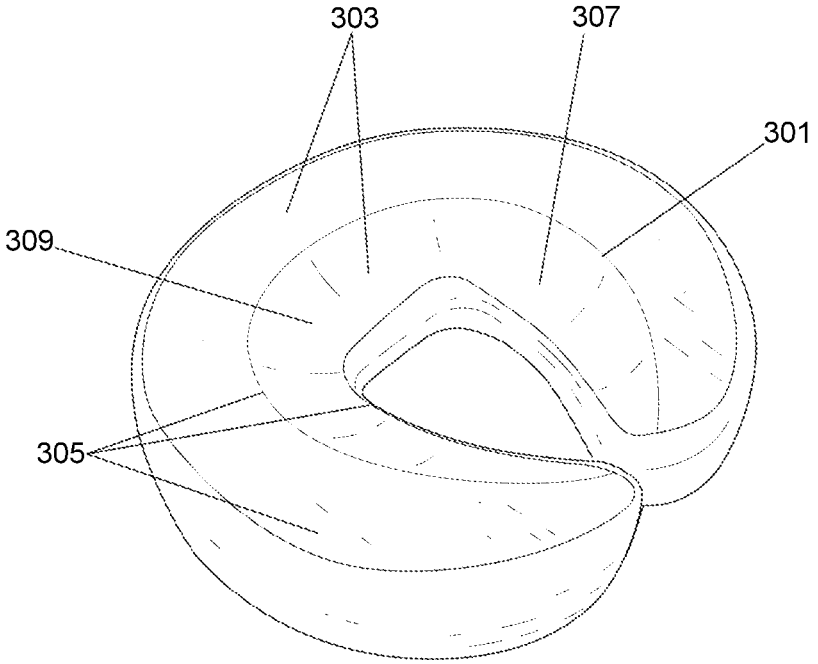
FIG. 3 is a three-quarter perspective view of another example prone lying enhancement pillow, in accordance with some embodiments.

FIG. 3 is a three-quarter perspective view of another example prone lying enhancement pillow 300, in accordance with some embodiments. As with other example prone lying enhancement pillows discussed in the present application, in some embodiments, example prone lying enhancement pillow 300 includes an interfacing surface 301 that faces a human user's forehead, and/or other portions of the user's face, when in use. And, in some such embodiments, such an interfacing surface covers a majority of the human user's forehead, as it is placed against it, when in use. However, in some such embodiments, such a surface does not cover all of the human user's forehead, allowing the user to shift the location of her or his face against the surface. And, in some embodiments, the interfacing surface 301 includes multiple levels 303 of topological features 305, each having different elevations from a floor on which a side opposite from the interfacing surface is placed. In some such embodiments, such multiple levels of topological features allow the user to alter the elevation of her or his head when using prone lying enhancement pillow 300, and thereby alter and select the angle of her or his neck (i.e., the angle of flexion and/or extension) to her or his liking. In some embodiments, such an interfacing surface includes a concave area(s) 307 of the pillow that touches and interfaces differently with specific contours of the human face. In some such embodiments, such a concave area includes an angled and contoured bevel 309 with a complementary fitment to a human user's face.

For example, in some embodiments, such an interfacing surface and concave area touches and interfaces with a majority of the user's forehead, thereby providing support and selective pressure to the user's forehead, and less pressure on other areas of the user's face, even if touching and interfacing with such other areas, owing to such concave area(s) 307.

Figure 4:
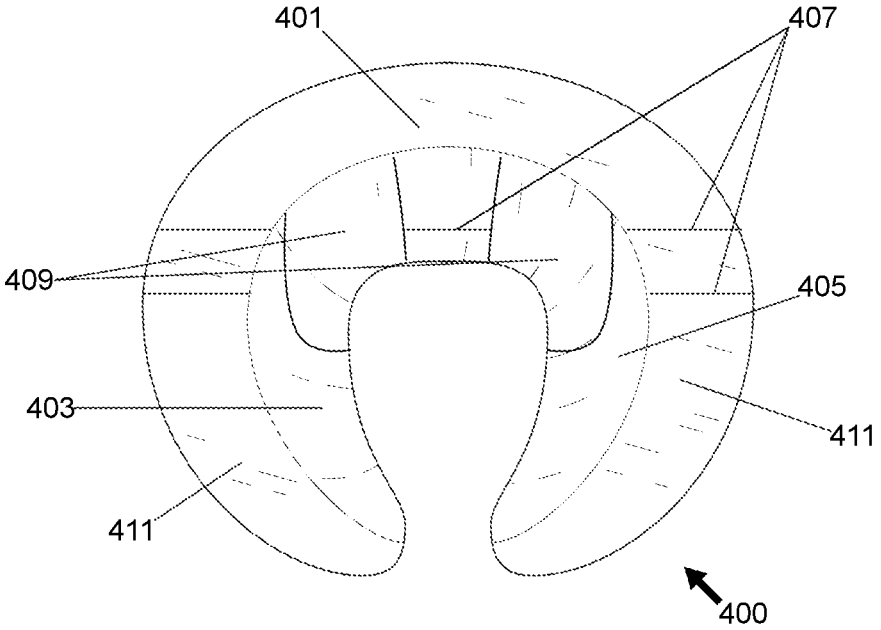
FIG. 4 is a side view of another example prone lying enhancement pillow, taken from a side of the pillow opposite from the side placed against the floor when in use, in accordance with some embodiments.

FIG. 4 is a side view of another example prone lying enhancement pillow 400, taken from a side of the pillow opposite from the side placed against the floor when in use, in accordance with some embodiments. In some embodiments, example prone lying enhancement pillow 400 may be the same as, or similar in nature to, the example prone lying enhancement pillow shown with respect to FIGS. 1-3. In some embodiments, example prone lying enhancement pillow 400 has at least some of the same components as shown in FIGS. 1-3, above, in accordance with some additional embodiments of the present application.

Among other aspects, as discussed above, in some embodiments, example prone lying enhancement pillow 400 includes an interfacing surface 401 that faces a human user's forehead, and/or other portions of the user's face, when in use, which may be the same as, or similar in nature to the interfacing surface 301, discussed above. And, in some embodiments, such an interfacing surface includes a concave area 403 of the pillow that touches and interfaces differently with specific contours of the human face.

In some such embodiments, such a concave area includes an angled and contoured bevel, such as that shown as example angled and contoured bevel 405, having a complementary fitment to a human user's face, which may be the same as, or similar in nature to, the example angled and contoured bevel 309, discussed above, in some embodiments. In addition, in some embodiments, ridges or other locally raised areas, such as the examples shown as example locally raised areas 407, may also be present within concave area 403, to create greater support and force against pressure points of a user's face, when placed against it, while in use. And, conversely, in some such embodiments, concave area 403 may include one or more areas of greater depth and/or concavity, such as examples shown as example eye and temple pressure relief areas 409, which correspond with the location of a user's eyes and/or temples when using example prone lying enhancement pillow 400, in some embodiments.

It should be noted that, in some embodiments, prone lying enhancement pillow 400 includes elongated sides 411 that form a crescent shape. However, in some embodiments, such elongated sides are straighter, descending along in a straight line vertically, or approximately vertically, in shape similar to that shown for prone lying enhancement pillow 100, discussed above.

Overall, in some embodiments, such an interfacing surface touches and interfaces with a majority of the user's forehead. And, in some embodiments, such an interfacing surface provides support and selective pressure to the user's forehead, and less pressure on other areas of the user's face, even if touching and interfacing with such other areas.

Figure 5:
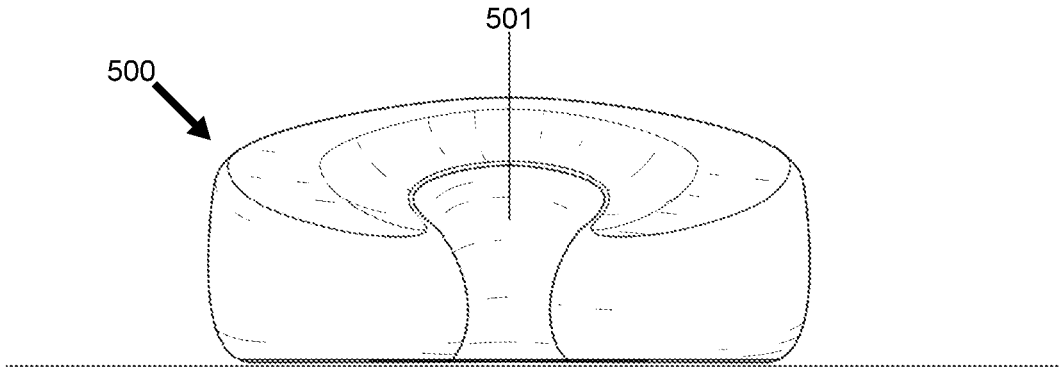
FIG. 5 is another side view of another example prone lying enhancement pillow, taken from a side of the pillow facing its central open channel, in accordance with some embodiments.

FIG. 5 is another side view of another example prone lying enhancement pillow 500, taken from a side of the pillow facing the central open channel 501, which may be the same as, or similar in nature to, the central channel 131 discussed above, in accordance with some embodiments. In some embodiments, example prone lying enhancement pillow 500 may be the same as, or similar in nature to, the example prone lying enhancement pillow shown with respect to FIGS. 1-4. In some embodiments, example prone lying enhancement pillow 500 has at least some of the same components as shown in FIGS. 1-4, above, in accordance with some additional embodiments of the present application.

Figure 6:
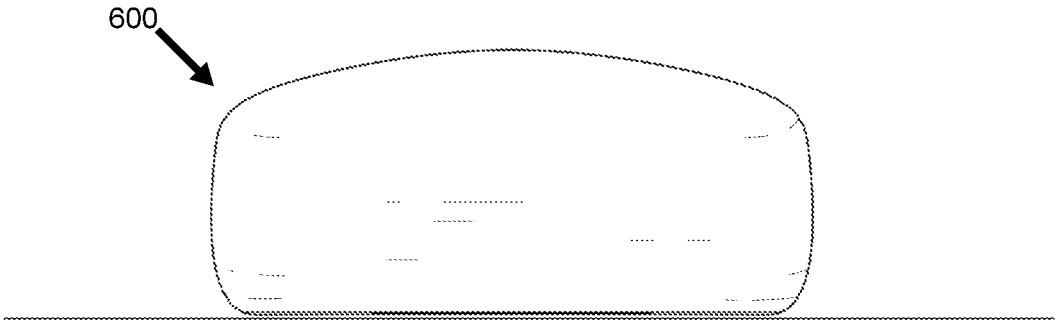
FIG. 6 is a top view drawing of another example prone lying enhancement pillow, taken from a side of the pillow opposite the central open channel discussed above, in accordance with some embodiments.

FIG. 6 is a top view drawing of another example prone lying enhancement pillow 600, taken from a side of the pillow opposite the central open channel discussed above, in accordance with some embodiments. In some embodiments, example prone lying enhancement pillow 600 may be the same as, or similar in nature to, the example prone lying enhancement pillow shown with respect to FIGS. 1-5. In some embodiments, example prone lying enhancement pillow 600 has at least some of the same components as shown in FIGS. 1-5, above, in accordance with some additional embodiments of the present application.

Figure 7:
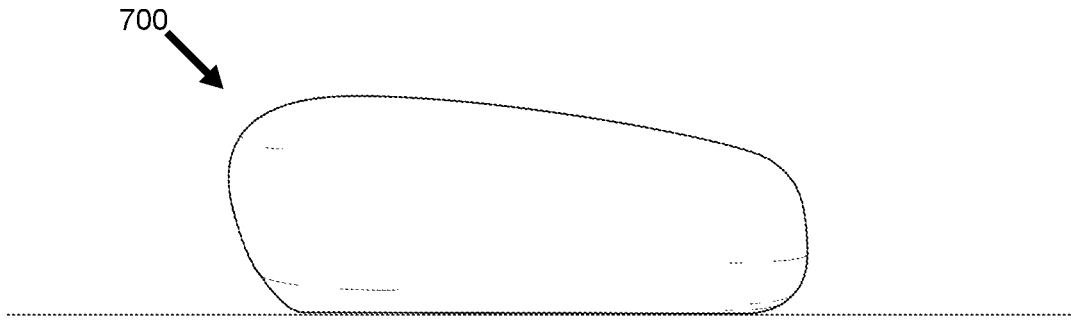
FIG. 7 is a left, side view drawing of an example prone lying enhancement pillow, in accordance with some embodiments.

FIG. 7 is a left, side view drawing of another example prone lying enhancement pillow 700, in accordance with some embodiments. In some embodiments, example prone lying enhancement pillow 700 may be the same as, or similar in nature to, the example prone lying enhancement pillow shown with respect to FIGS. 1-6, above. In some embodiments, example prone lying enhancement pillow 700 has all, or at least some of the same components as shown in FIGS. 1-6, above, in accordance with some additional embodiments of the present application.

Figure 8:
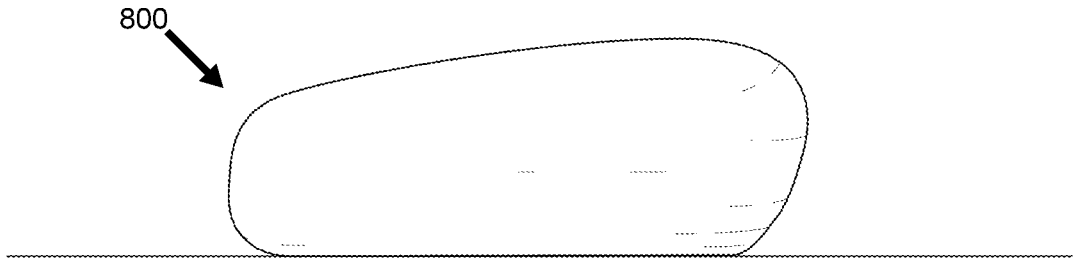
FIG. 8 is a right, side view drawing of an example prone lying enhancement pillow, in accordance with some embodiments.

FIG. 8 is a right, side view drawing of another example prone lying enhancement pillow 800, in accordance with some embodiments. In some embodiments, example prone lying enhancement pillow 800 may be the same as, or similar in nature to, the example prone lying enhancement pillow shown with respect to FIGS. 1-7, above. In some embodiments, example prone lying enhancement pillow 800 has all, or at least some of the same components as shown in FIGS. 1-7, above, in accordance with some additional embodiments of the present application.

Figure 9:
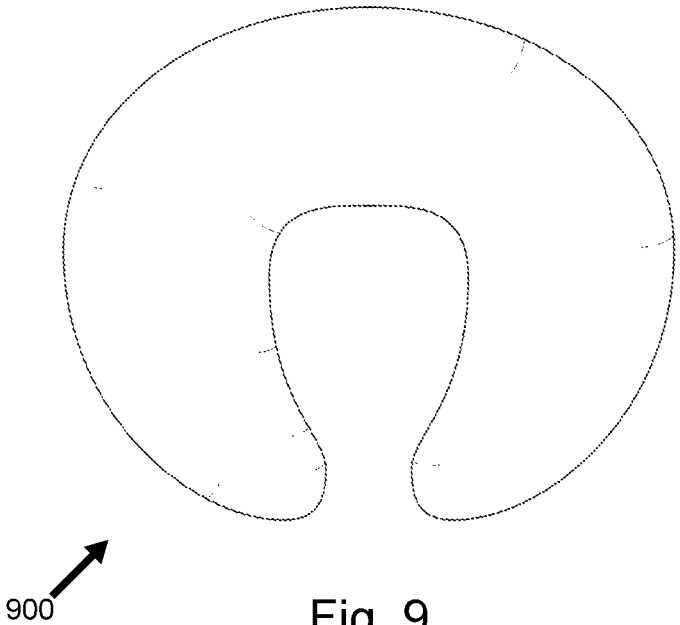
FIG. 9 is a bottom view drawing of another example prone lying enhancement pillow (take from the same perspective as shown in FIG. 1, above), in accordance with some embodiments.

FIG. 9 is a bottom view drawing of another example prone lying enhancement pillow 900 (take from the same perspective as shown in FIG. 1, above, with respect to example prone lying enhancement pillow 100), in accordance with some embodiments. In some embodiments, example prone lying enhancement pillow 900 may be the same as, or similar in nature to, the example prone lying enhancement pillow shown with respect to FIGS. 1-8, above. In some embodiments, example prone lying enhancement pillow 900 has all, or at least some of the same components as shown in FIGS. 1-8, above, in accordance with some additional embodiments of the present application.

In some embodiments, the prone lying enhancement pillows discussed in the present application are coupled with a custom-fitted tote bag, or other carrying bag, to enhance portability of the prone lying enhancement pillows. For example, in some embodiments, such a custom carrying bag is made of smooth nylon and/or includes structural members arranged in a honeycomb pattern, which, in some embodiments, enhances breathability of the tote and speeds drying. Some embodiments include a fastener (such as a zipper), for safely securing the pillow inside the custom carrying bag, which is all machine washable and safe.

It should be understood that the above components, steps, and number and order of components and steps, is exemplary only of certain embodiments set forth in this application, and are not intended to limit the application in any way. In fact, virtually unlimited alternative orders, numbers, instances of the above steps and components, in addition with countless additional and alternative steps may be performed, within the scope of the present application and inventions herein, as will be readily apparent to those of skill in the art. Although the example of a prone lying enhancement pillow including certain specified material(s), such as a memory foam and/or a high density, small cell foam, has been provided, it should be understood that any suitable alternative form of cushioning material may be used, instead of, or in addition to, such a memory foam and/or high density, small cell foam material, in various embodiments, while carrying out aspects of the present inventions, as will be readily apparent to those of skill in the art.

What is claimed is:

1. A portable pillow, comprising:

an at least generally flat bottom;

an at least generally U-shaped outer perimeter, wherein said U-shaped outer perimeter comprises an upper surface, the upper surface having a first height;

at least one central breathing cove and/or channel, defined, at least in part, by said U-shaped perimeter;

a central cushioning matrix, comprising the core of said portable pillow, comprising a compliant, supportive, resilient material;

wherein said upper surface is contoured to touch and conform to surface features of a human user's face, including at least one concave area having a second height causing lower pressure to the user's eyes, sinuses, and/or lower face than at the user's forehead, while the human user is lying in the prone position, face-down, with the human user's face placed downward against it and into the breathing cove and/or channel; and wherein the concave area includes at least one locally raised area and a plurality of temple pressure relief areas having locally lower areas, wherein the first height is greater than the second height.

2. The portable pillow of claim 1, wherein the portable pillow is configured to lift the human user's face to a minimum clearance from a ground upon which said flat bottom is placed when said human user is so lying.

3. The portable pillow of claim 2, wherein the portable pillow is configured to reduce the angle of the human user's neck to less than or about equal to 10 degrees flexion or extension, while the human user is so lying.

4. The portable pillow of claim 3, wherein the portable pillow is configured to allow the human user to adjust the angle of flexion or extension of the human user's neck by placing different areas of the human user's face against different pockets, ridges and/or contours of said upper surface having different levels of elevation from said flat bottom, when said flat bottom is placed upon a ground.

5. The portable pillow of claim 1, wherein the portable pillow is configured to reduce the angle of the human user's neck to less than or about equal to 10 degrees flexion or extension, while the human user is so lying.

6. The portable pillow of claim 1, wherein the material comprises polyurethane.

7. The portable pillow of claim 1, wherein the material comprises a memory foam, or other high-density, small-cell foam.

8. The portable pillow of claim 1, wherein the at least one central breathing cove or channel comprises at least one of: (a) a plurality of breathing coves or (b) a plurality of breathing channels.

9. The portable pillow of claim 1, wherein said upper surface is contoured to make contact with, and apply pressure to, at least one beneficial pressure point of the human user's face resting in the pillow.

10. The portable pillow of claim 9, wherein said upper surface is contoured to make contact with, and apply pressure to, two bilaterally symmetrical beneficial pressure points of the human user's face.

11. The portable pillow of claim 10, wherein the two bilaterally symmetrical beneficial pressure points are, or are at or about, the human user's temples.

12. The portable pillow of claim 9, wherein said upper surface is contoured to reduce pressure to the human user's sinuses.

13. The portable pillow of claim 9, wherein said upper surface is contoured to reduce pressure to the human user's eyes.

14. The portable pillow of claim 1, wherein the compliant, supportive, resilient material has a compression rating (IFD) within the range of 12 to 75 pounds.

15. The portable pillow of claim 14, wherein the material has a compression rating (IFD) within the range of 35 to 50 pounds.

16. The portable pillow of claim 15, wherein the material has a compression rating (IFD) of 44 pounds.

17. The portable pillow of claim 1, wherein the material has a compression rating (IFD) of at or about 45 pounds, with a density of at or about 26 pounds per cubic foot.

18. The portable pillow of claim 1, comprising an air filtering material located at or about the breathing cove and/or channel, filtering particles, chemicals or other things from entering the human user's airway.

19. The portable pillow of claim 1, wherein the central cushioning matrix comprises, or is comprised within, a cushion measuring about 12 inches long by 12 inches wide by 1 inch thick.

20. The portable pillow of claim 1, wherein the central cushioning matrix comprises, or is comprised within, a cushion measuring about 5 inches long by 5 inches wide by 2 inch thick.

* * * * *